US008256154B2

(12) United States Patent
Danielson et al.

(10) Patent No.: US 8,256,154 B2
(45) Date of Patent: Sep. 4, 2012

(54) LASER GUNSIGHT SYSTEM FOR A FIREARM TRIGGER GUARD

(75) Inventors: Lewis A. Danielson, Newberg, OR (US); Daniel Lee Hughes, Damascus, OR (US)

(73) Assignee: Crimson Trace Corporation, Wilsonville, OR (US)

( * ) Notice: Subject to any disclaimer, the term of this patent is extended or adjusted under 35 U.S.C. 154(b) by 847 days.

(21) Appl. No.: 12/286,491

(22) Filed: Sep. 30, 2008

(65) Prior Publication Data

US 2012/0144718 A1 Jun. 14, 2012

(51) Int. Cl.
*F41G 1/35* (2006.01)

(52) U.S. Cl. ..... 42/146; 42/117

(58) Field of Classification Search ..... 42/114, 42/117, 146; 362/110, 114
See application file for complete search history.

(56) References Cited

U.S. PATENT DOCUMENTS

| | | | | | |
|---|---|---|---|---|---|
| 958,332 | A | | 5/1910 | Snyder | |
| 1,263,667 | A | * | 4/1918 | Henderson et al. | 362/114 |
| 2,450,584 | A | * | 10/1948 | Dodge | 362/114 |
| 5,056,254 | A | * | 10/1991 | Bechtel | 42/114 |
| 5,282,594 | A | | 2/1994 | Huang | |
| 5,485,695 | A | | 1/1996 | Glock | |
| 5,581,898 | A | | 12/1996 | Thummel | |
| 5,590,486 | A | | 1/1997 | Moore | |
| 5,621,999 | A | * | 4/1997 | Moore | 42/117 |
| 5,654,594 | A | * | 8/1997 | Bjornsen et al. | 307/115 |
| 5,706,600 | A | | 1/1998 | Toole et al. | |
| 5,758,448 | A | | 6/1998 | Thummel | |
| 6,230,431 | B1 | * | 5/2001 | Bear | 42/117 |
| 6,276,088 | B1 | * | 8/2001 | Matthews et al. | 42/1.03 |
| 6,378,237 | B1 | * | 4/2002 | Matthews et al. | 42/124 |
| 6,393,752 | B1 | | 5/2002 | Oliver et al. | |
| 6,438,888 | B1 | | 8/2002 | Lin et al. | |
| 7,117,627 | B2 | | 10/2006 | Woodmansee, III et al. | |
| 7,275,344 | B2 | | 10/2007 | Woodmansee, III et al. | |
| 7,395,627 | B2 | | 7/2008 | La France et al. | |

OTHER PUBLICATIONS

LaserLyte product flyer.
Armalaser website product description.
Pocket Slipper product information sheet.

* cited by examiner

*Primary Examiner* — Bret Hayes
(74) *Attorney, Agent, or Firm* — Bennet K. Langlotz; Langlotz Patent & Trademark Works, Inc.

(57) ABSTRACT

The present invention provides a sighting device for a firearm having a trigger guard, a frame with an underside portion forward of the trigger guard, and a handgrip with a front strap. The sighting device has a body having a first portion including an illumination device. The body defines an engagement feature operable term the bubbly connectivity for portion of the trigger guard. The body has an elongated extension portion that extends from the first portion. The extension portion is shaped to underlie a lower portion of the trigger guard from the first portion to the front strap. The extension portion has a free end including a switch, and the extension portion includes a conductor operably connecting the switch to the illumination device.

29 Claims, 4 Drawing Sheets

LASER GUNSIGHT SYSTEM FOR A FIREARM TRIGGER GUARD

FIELD OF THE INVENTION

This invention relates to a laser gunsight system designed to fit the trigger guard of a firearm without requiring significant modification of the firearm, the laser gunsight being operable by the user while the firearm is gripped by the handgrip in the firing position.

BACKGROUND AND SUMMARY OF THE INVENTION

When using firearms, it is often advantageous for the user to be able to quickly and accurately point the firearm at the target. Many devices assisting in the aiming of a firearm are available, including the classic V-sight, peephole sight, 3-dot sight and similar iron-sight structures, as well as telescopic or optical sights. However, when light conditions are poor, such as at night or in darkened rooms of buildings, a sighting device that relies on ambient light is at a disadvantage. Under such conditions, the target may itself be difficult to acquire visually and to follow if it is moving, and gunsights that are lit only by external light sources are less effective because of the need to see them and align them with the already poorly-perceived target at the time of firing the firearm.

Under poor lighting conditions, self-illuminated gunsights such as tritium sights may be used, but again the effectiveness of such sights depends on the user's ability to align them accurately with a possibly poorly-seen and/or moving target. This is particularly significant for police and military users of firearms, who in the course of their duties may very likely be confronted with a moving, dangerous threat under poor lighting conditions. To accommodate such users, sights have been developed wherein a battery-powered laser is used, the laser having been adjusted to illuminate the point of aim of the firearm. When the laser is turned on by the user of the firearm, it shines light in the direction the bullet will travel when the firearm is fired. Thus, the firearm is aimed merely by directing the laser beam towards the target. The laser beam strikes the target and is reflected back to the user's eye, informing the user exactly where the firearm is aimed and thus what the point of impact of a bullet will be if the firearm is fired.

Various laser gunsight systems have been developed for use with firearms that are equipped with a handgrip, such as handguns and long guns having a buttstock with a "pistol-grip." The handgrip of a handgun is grasped by the user's hand or hands when the firearm is being held in the firing position. With a long gun, i.e. a rifle or a shotgun equipped with a handgrip or pistol-grip, typically the rear or "trigger" hand holds the handgrip while the front hand holds the forestock when the firearm is in the firing position.

Toole et al., U.S. Pat. No. 5,706,600 ("Toole et al.") discloses a laser mounted at the front of the trigger guard of an automatic pistol and an actuation switch located at the back, underside of the trigger guard. However, the power supply is located in the grip of the pistol, and wires run from the power supply to the switch, to the laser, and back to the power supply through the frame of the pistol. The pistol must be modified to accommodate the wires and switch mounting. Moreover, the laser mounting also requires modification of the front of the trigger guard.

Snyder, U.S. Pat. No. 958,332 ("Snyder") discloses an illumination device, which is not an aiming device, for a revolver that has a light mounted in front of the trigger guard underneath the barrel, a trigger-like actuation switch disposed at the back, underside of the trigger guard, a power supply in the grip, and wires running through the frame of the revolver to connect these components. Like Toole et al., Snyder requires the revolver to either be inherently built to accommodate these features or modified to do so.

Glock, U.S. Pat. No. 5,485,695 ("Glock") discloses a semi-automatic pistol having a laser disposed at the front of the trigger guard and a switch for actuating the laser built into the top of the bottom portion of the trigger guard. The switch is pivoted at the back interior of the trigger guard and moves down at the front of the trigger guard under pressure from the finger of the user to actuate the laser. This is not a device for mounting on an automatic weapon; rather, it is built into an automatic weapon. Also, the switch placement and way the switch is actuated is much different from that taught by the current invention.

Thummel, U.S. Pat. No. 5,581,898 discloses a laser aiming device for mounting on a semi-automatic pistol, wherein the device comprises two interconnecting parts: a mounting block that is mounted on the front of the trigger guard and clamps thereto and a main housing structure that attaches to the mounting block. An actuation switch is disposed on the main housing structure forward of the trigger guard.

A pistol-mounted illumination device, which is not an aiming device, is also known that has a flashlight disposed at the front of the trigger guard and a switch for actuating the flashlight touching the handgrip's front strap. However, the switch is attached to the flashlight using a fragile, flexible connection that is easily damaged. Furthermore, the switch is not secured against the front strap, nor is the flashlight firmly secured to the trigger guard. While maintaining critical alignment of the flashlight with respect to the gunbarrel is not essential since the flashlight's beam is too imprecise for accurate targeting, laser aiming devices must be firmly secured to maintain their alignment with respect to the gunbarrel to ensure accurate targeting.

Additional types of laser aiming devices for pistols are known. One example has a laser attached to the front of a pistol's trigger guard, leaving the remaining lower portion of the trigger guard exposed. However, the laser is activated by a switch mounted in front of the trigger finger that is remote from where the trigger finger normally lies. This does not provide for natural, instinctive operation by requiring the user to disrupt his grip on the pistol in a critical situation. Furthermore, one of the gun's assembly pins has to be removed and reinstalled in order to secure this laser aiming device in place. Removing the gun's assembly pin requires some knowledge of gunsmithing on the part of the installer and could disrupt the gun's internal components, causing the gun to malfunction. Even if removal of the assembly pin were easy, many users perceive any disassembly of their firearms as being risky. Therefore, they will avoid products requiring even only partial disassembly. In addition, this device does not extend along the lower portion of the trigger guard.

A second example has a laser attached to the front of a pistol's trigger guard and is rigid from the pistol's muzzle to the front strap. However, it has a large bridge from the front laser portion to the rear switch portion. The bridge does not extend along the lower portion of the trigger guard, but passes below the middle finger. This forces that finger, which controls the illumination switch, to pass through a hole. This makes acquiring a proper grip awkward and limits the finger's movement.

A final example is a laser attached to the front of a pistol's trigger guard and a switch for actuating the laser touching the handgrip's front strap. However, the switch is attached to the laser using a fragile, flexible connection that is easily damaged. Furthermore, the switch is not secured against the front strap.

Therefore, there is a need for a laser sighting system that may be used with standard, unmodified firearms and that does not require replacement of handgrips, attachment of special rails, removal and reinstallation of firearm pins, or other modifications. Furthermore, a system that can be readily operated by a user with the firearm in firing position, using only the hand gripping the firearm without requiring movement of the hand from the position normally used when aiming and firing the firearm, would be advantageous.

The present invention overcomes the limitations of the prior art by providing a sighting device for a firearm having a trigger guard, a frame with an underside portion forward of the trigger guard, and a handgrip with a front strap. The sighting device has a body having a first portion including an illumination device. The body defines an engagement feature operable term the bubbly connectivity for portion of the trigger guard. The body has an elongated extension portion that extends from the first portion. The extension portion is shaped to underlie a lower portion of the trigger guard from the first portion to the front strap. The extension portion has a free end including a switch, and the extension portion includes a conductor operably connecting the switch to the illumination device.

DETAILED DESCRIPTION OF A PREFERRED EMBODIMENT

Figure 1:
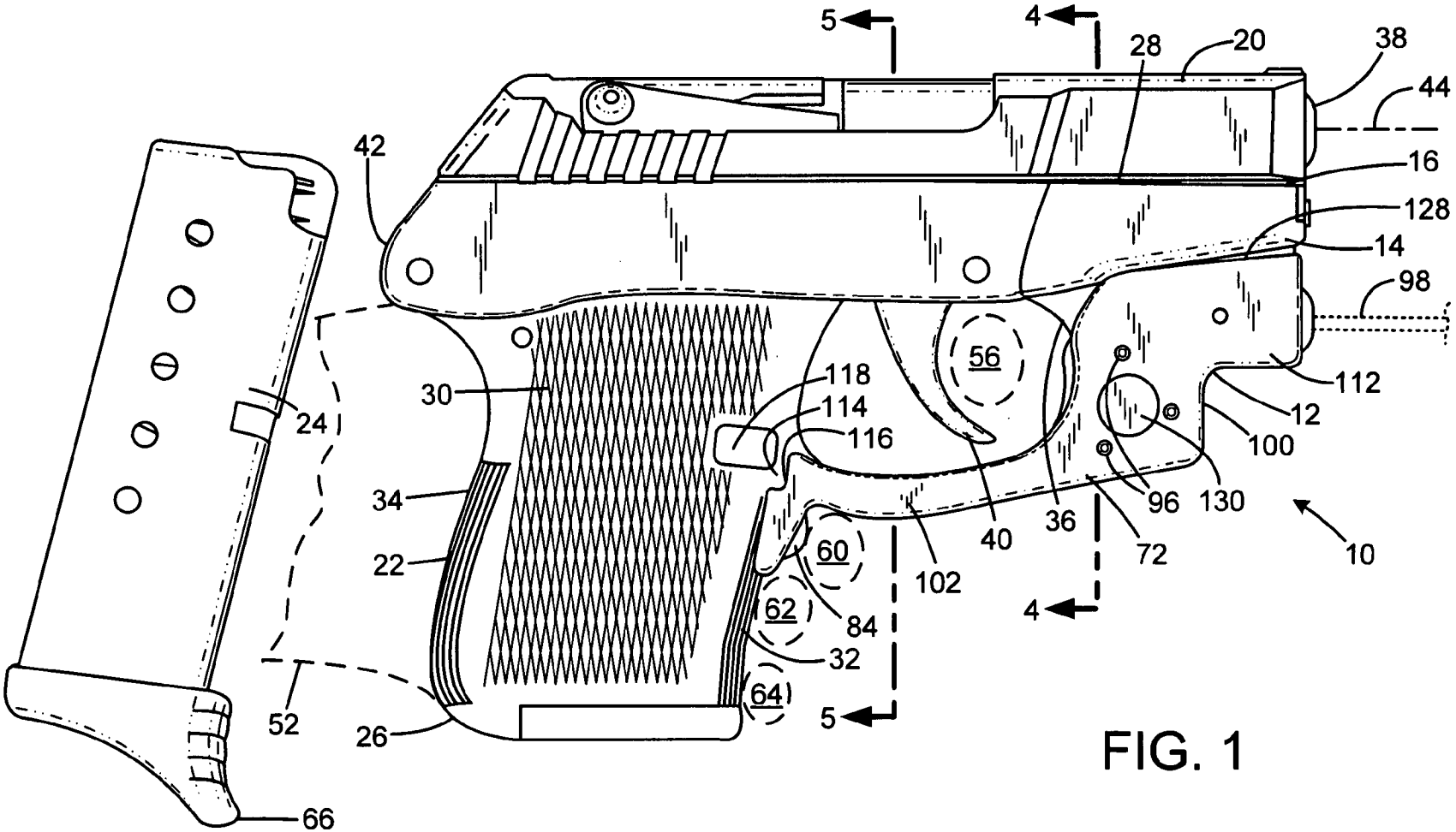
FIG. 1 is a right side view of a preferred embodiment of the invention as installed on a pistol.

FIG. 1 shows a firearm 10 with an attached laser aiming device 12. The pistol has a one-piece integrally molded plastic frame 14 that includes an upper edge 16 immediately below the lower edge 28 of a slide 20 that reciprocates with respect to the pistol during chambering of cartridges and ejection of casings. The slide includes a barrel 38 having a barrel axis 44. Note that the device may be employed on any type of pistol or firearm in addition to those with integrally-molded frames, including any firearm having the conventional configuration of a grip adjacent to a trigger surrounded by a trigger guard.

The frame has a downwardly-extending handgrip 22 that angles slightly rearward and is a tubular body defining a well receiving a magazine 24. The handgrip has a lower free end 26. The grip has flat side portions 30, a curved front strap 32 facing forward, and a curved back strap 34 facing rearward. The grip generally has an oblong or "racetrack" cross section. At the upper end of the front strap, a trigger guard 36 projects forward and upward to protect the trigger 40 from accidental discharge. Two handgrip protrusions 114, only one of which is visible, protrude from the sides of the handgrip adjacent to the trigger guard. The handgrip protrusions are generally rectangular ridges with rounded edges that protect the magazine catch 118 in the handgrip from inadvertent activation. The back strap extends nearly to the upper edge 16 of the frame, curving rearward at its upper portion. A beavertail protrusion portion 42 of the frame protrudes rearward at the upper end of the back strap.

When a user grips the gun normally with his hand 52, the user's index (trigger) finger 56 is easily inserted into the trigger guard to press the trigger for firing. The middle finger 60 is positioned immediately below the trigger guard, just forward of the front strap. The ring finger 62 is positioned just below the middle finger, resting on the front strap. The little finger 64 is below the ring finger, just above a protrusion 66 on the front edge of a plate at the lower end of the magazine.

Figure 2:
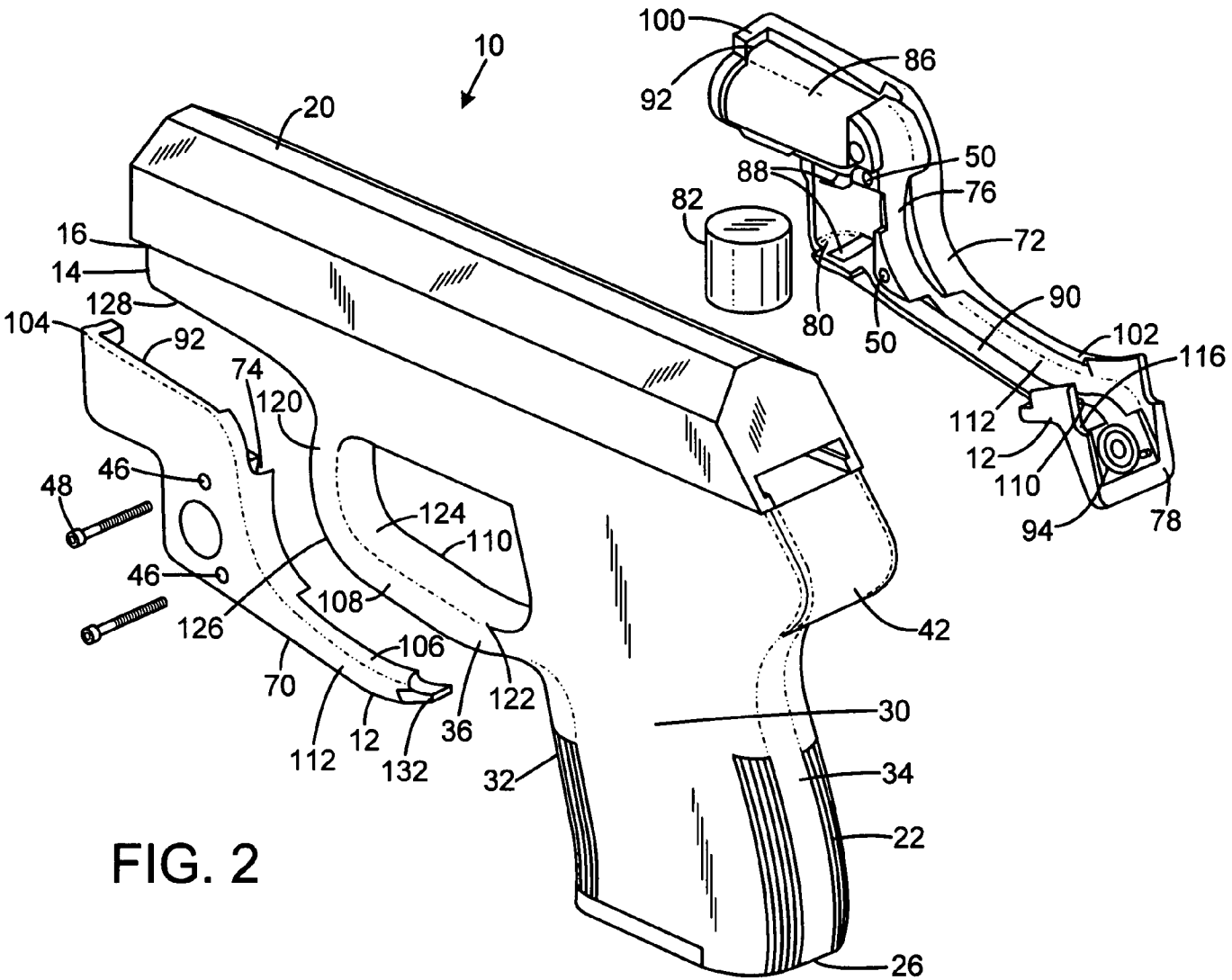
FIG. 2 is an exploded perspective view of the embodiment of FIG. 1, showing the interior of the device.

FIG. 2 shows the laser aiming device 12 detached from the pistol. The device has a body 112 comprising a left panel or cover 70 and an opposed right panel or device body 72 that are drawn together by screws 48 to clamp onto the pistol's trigger guard. For installation and removal of the device, nothing on the pistol needs to be modified, adjusted, moved, removed, or reinstalled. In fact, the device is free of any fasteners engaging the firearm. This ensures that proper assembly and safety measures are not compromised and that users will feel comfortable installing their own device, thereby avoiding the expense of professional installation. It also prevents the disruption or marring of any surface, so that the device may be installed and removed without any evidence that it was ever installed.

The trigger guard is a loop surrounding the trigger 40 with a forward portion 120 that curves downward and rearward from the frame's underside 128 to a location in front of the trigger. There, the forward portion meets a generally horizontal lower portion 122 that extends below the trigger before curving upward and rearward behind the trigger to meet the front strap. The trigger guard has an exterior consisting of an inner surface 124 that faces towards the trigger, a bottom surface 126 that faces away from the trigger, and lateral surfaces in the form of a left side 108 and a right side 110 that connect the inner surface to the bottom surface. The device is kept secure on the trigger guard by the close conformance of the interior of the left and right panels to the trigger guard's exterior, the close conformance of the front portions of the left and right panels to the lower surface of the front of the pistol's frame, and the close conformance of the switch panel to the handgrip's front strap and the handgrip protrusions.

The left panel has two left screw holes 46, which receive the heads of screws 48, and a left trigger guard receiving slot 74. The left trigger guard receiving slot is adapted to fit the left side of the pistol's trigger guard, and has the form of a channel that closely receives the trigger guard's inner, left side, and bottom surfaces. The front portion 104 of the left panel is adapted to abut the underside of the pistol's frame, and the rear portion 106 of the left panel is adapted to abut the left side of the pistol trigger guard. The right panel has two right screw holes 50, which receive the threaded ends of screws 48, and a right trigger guard receiving slot 76. The right trigger guard receiving slot is adapted to fit the right side of the pistol's trigger guard. The front portion 100 of the right panel is adapted to abut the underside of the pistol's frame, and the rear portion 102 of the right panel is adapted to abut the right side of the pistol trigger guard.

The rear portion of the right panel has a free end that terminates in a switch panel 78 that is adapted to abut the handgrip's front strap immediately below the trigger guard. The switch panel has two handgrip protrusion slots 116 that closely conform to the handgrip protrusions. A forward-facing momentary on-off switch 84 having a flexible rubber actuator is mounted at the center of the switch panel, where it can be closed by the application of slight upward pressure by the user's middle finger. The momentary on/off switch may be a mechanical pressure switch, a heat sensitive switch, an electrical contact switch, or any other suitable switch. In alternative embodiments, the switch may be of any other operation configuration, including click-on/click-off and such.

The shape of the laser aiming device housing body is partly dictated by the goal that the device have minimal perceived effect on the size of the trigger guard and handgrip in a user's hands. This means that the device has the minimum volume to enclose needed components and dimensions needed for strength and durability. The illustrated curved shapes are provided for an aesthetic appearance and for comfort. The minimal, "skeletonized" form also minimizes weight, and further facilitates installation and removal of the device from the firearm by reducing friction and potential interference. The extension is thin enough to avoid adding appreciable thickness of the lower part of the trigger guard, which avoids pushing the user's hand significantly downward on the grip, which is important for very compact pistols with limited grip length.

The body has left and right panels that are each molded as a single piece from thermoplastic, such as nylon or ABS, which provides compatibility with the nylon material typically used for pistol frames. While no plastic is entirely rigid, the material is essentially rigid in the sense that it does not elongate or compress in any significant way that affects dimensions or functionality during installation or use. The left and right panels are essentially inelastic, and this provides a material comparable in characteristics and appearance to materials used for molding plastic pistol frames. Furthermore, this material makes the left and right panels sufficiently rigid that the panels are prevented from pivoting about the trigger guard by the positive locating effect of their areas of contact by the switch panel with the front strap and handgrip protrusions and by the front portions of the panels with the underside of the pistol's frame.

The body contains a number of electronic components. The front portions of the left and right panels have recesses forming a laser diode compartment 92 and a battery compartment 80. The laser diode compartment receives a laser diode 86, which is slightly recessed within the laser diode compartment 92 to minimize fouling from muzzle gases. The battery compartment receives a battery 82, which is interchangeably either one ⅓ N battery or two 357 batteries in the current embodiment. The battery is electrically connected by terminals 88 in the right panel's portion of the battery compartment to laser driving circuitry 90. The laser driving circuitry is also electrically connected to the laser diode and flexible circuitry 94. The momentary on-off switch having a flexible rubber actuator is mounted at the center of the switch panel above the flexible circuitry and controls the flow of electricity from the battery to the laser diode. Set screws 96, which are shown in FIG. 1 recessed in the right panel, provide aiming adjustments with respect to the barrel axis of the laser beam 98 projected by the laser diode for windage and elevation.

An on-off master switch is hidden beneath the logo 130 on the laser aiming device's 12 right panel 72 (shown in FIG. 1). The on-off master switch prevents inadvertent illumination of the laser aiming device 12 because the laser aiming device 12 will not illuminate unless the on-off master switch is in an on condition. The electronic components within the laser aiming device 12 respond to the short made by the on-off master switch to toggle between on mode and off mode.

Figure 3:
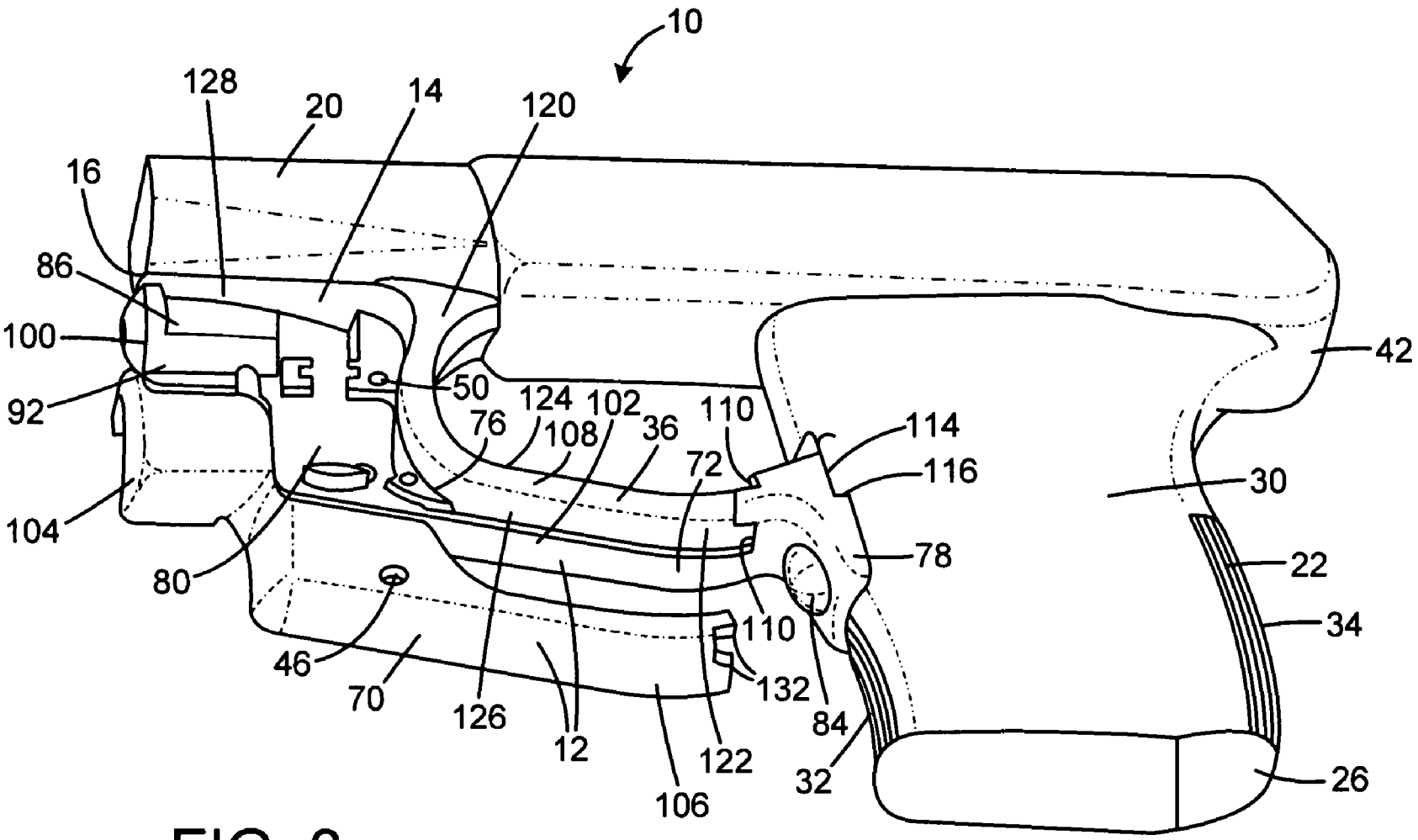
FIG. 3 is an exploded perspective view of the embodiment of FIG. 1, showing the right panel attached to a firearm with the left panel removed.

FIG. 3 shows the laser aiming device 12 with the right panel installed on the pistol and the left panel detached from the pistol. Two tail slots 110 in the rear portion of the right panel that are generally perpendicular to one another receive two tails 132 protruding from the rear portion of the left panel that are generally perpendicular to one another to releasably secure the rear portion of the left panel to the rear portion of the right panel. When the left panel's tails are engaged with the tail slots, the left panel cannot shift rearward towards the rear strap, downward parallel to the rear strap, or lift away from the trigger guard's left side because these movements are blocked by the rear portion of the right panel that forms the tail slots.

Figure 4:
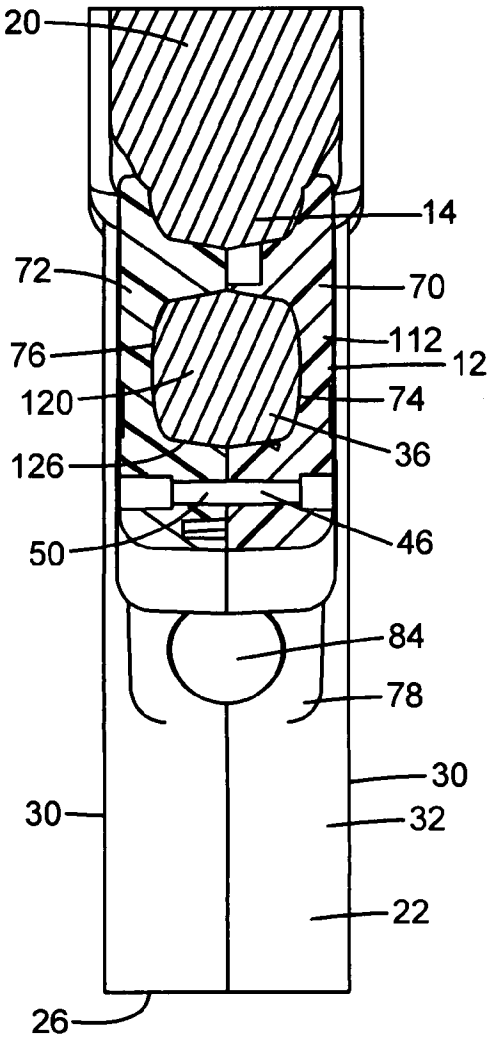
FIG. 4 is a cross-sectional view, taken along the line 4-4 in FIG. 1, facing rearward from the front of the trigger guard of the embodiment of FIG. 1.

FIG. 4 shows the laser aiming device 12 installed on the pistol. The left and right panels closely conform to the underside 128 of the pistol's frame. The left and right trigger guard receiving slots 74 and 76 closely encircle the forward portion of the trigger guard. The trigger guard receiving slots are concave channels that prevent the laser aiming device from slipping off of the trigger guard. The trigger guard receiving slots create a clamping action about the trigger guard when screws are threadedly inserted through the left and right screw holes to secure the laser aiming device to the pistol.

Figure 5:
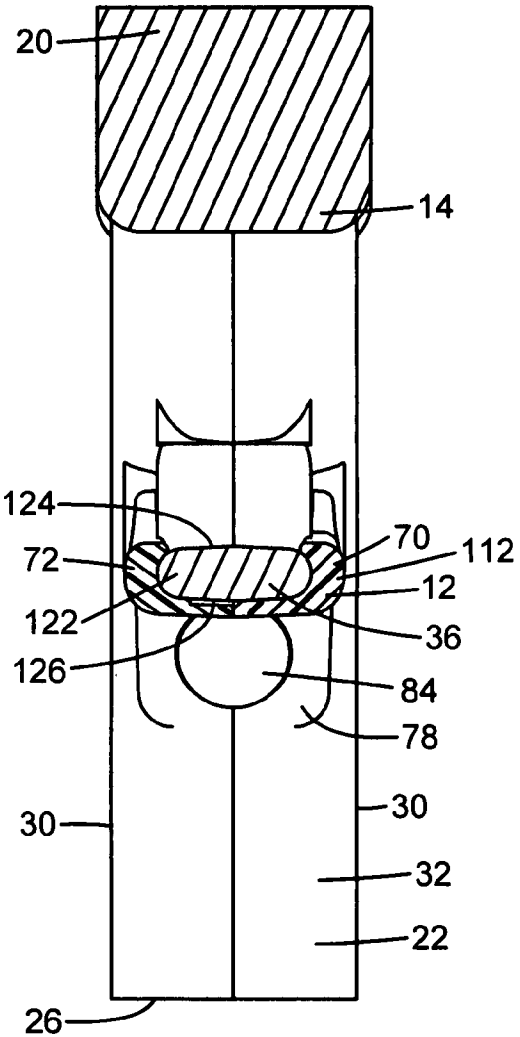
FIG. 5 is a cross-sectional view, taken along the line 5-5 in FIG. 1, facing rearward from the middle of the trigger guard of the embodiment of FIG. 1.

FIG. 5 shows the laser aiming device 12 installed on the pistol. The left and right panels wrap the trigger guard's bottom surface and left and right sides to secure the laser aiming device to the pistol. The inner surface of the trigger guard is left exposed, avoiding reducing the space inside the trigger guard.

While a current embodiment of the sighting device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, while disclosed in the context of a pistol, the device may similarly be applied to a rifle having a protruding handgrip and trigger guard.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A sighting device for a firearm having a trigger guard, a frame with an underside portion forward of the trigger guard, and a handgrip with a front strap, the sighting device comprising:

a body having a first portion including an illumination device;

the body defining an engagement feature operable to removably connect to and closely encircle a forward portion of the trigger guard to create a clamping action about the trigger guard;

the body having an elongated extension portion extending from the first portion;

the extension portion shaped to wrap a bottom surface and left and right sides of the trigger guard from the first portion to the front strap;

the extension portion having a free end including a switch;

the switch having electrical contacts located below the lower portion of the trigger guard and being electrically connected to electrical contacts at the forward portion of the trigger guard; and the extension portion including an electrical conductor operably connecting the switch to the illumination device.

2. The sighting device of claim 1, wherein the illumination device is a laser.

3. The sighting device of claim 1, wherein the engagement feature is a channel closely encompassing a portion of the trigger guard.

4. The sighting device of claim 1, wherein the body has two parts secured together, with the trigger guard closely received between the two parts.

5. The sighting device of claim 1, wherein the extension is integrally molded with at least a major portion of the first portion.

6. The sighting device of claim 1, wherein the extension is unitary with the first portion.

7. The sighting device of claim 1, wherein the extension and the first portion are made from a common material.

8. The sighting device of claim 1, wherein the extension is sufficiently rigid to resist displacement.

9. The sighting device of claim 1, wherein the extension is made from a thermoplastic.

10. The sighting device of claim 1, wherein the extension's free end including the switch overlays a portion of the front strap.

11. The sighting device of claim 1, wherein the extension defines a channel, such that it encompasses bottom and side surfaces of a lower portion of the trigger guard.

12. The sighting device of claim 1, wherein the first portion has an upper surface configured to abut the underside portion of the frame.

13. A sighting device for a firearm having a trigger guard, a frame with an underside, and a handgrip with a front strap, the sighting device comprising:

a body closely encircling at least a portion of the trigger guard and having a rear portion closely conforming to a portion of the front strap;

a switch mounted on the body's rear portion;

the switch having electrical contacts located below the trigger guard and being electrically connected to electrical contacts forward of the trigger guard; and an illumination device connected to the body.

14. The sighting device of claim 13, further comprising the body having a front portion adapted to abut the underside portion of the frame.

15. The sighting device of claim 13, wherein the sighting device is rigidly connected to the trigger guard and front strap.

16. The sighting device of claim 13, wherein the illumination device is a laser.

17. The sighting device of claim 13, wherein the illumination device is enclosed in a housing integral with the body.

18. The sighting device of claim 13, further comprising a power source enclosed in a housing integral with the body.

19. The sighting device of claim 13, wherein the body comprises a left panel and a right panel that are removably attached to one another.

20. The sighting device of claim 19, wherein the left panel and the right panel are clamped to the trigger guard.

21. The sighting device of claim 13, wherein the body wraps the trigger guard's bottom, left, and right sides.

22. The sighting device of claim 13, wherein the body is formed of a rigid thermoplastic.

23. The sighting device of claim 13, wherein the body has a front portion closely conforming to a portion of the frame's underside.

24. The sighting device of claim 13, wherein the body's rear portion has a limited width substantially less than the length of the front strap, such that a majority of the front strap is exposed when the device is installed on the firearm.

25. The sighting device of claim 24, wherein the body's rear portion is configured to be positioned immediately below the trigger guard, and the limited width corresponds to the width of a finger.

26. The sighting device of claim 13, wherein the device is free of any fasteners engaging the firearm.

27. A sighting device for a firearm having a frame having an underside, a trigger guard, and a handgrip having a front strap, the sighting device comprising:

a body having a front portion configured to closely conform to a portion of the frame's underside;

the body having a middle portion configured to wrap the trigger guard's bottom, left, and right sides and to closely encircle a forward portion of the trigger guard;

the body having a rear portion configured to closely conform to a portion of the front strap immediately below the trigger guard;

a laser device connected to the body;

a switch mounted on the body's rear portion; and the switch having electrical contacts located below the trigger guard and being electrically connected to electrical contacts forward of the trigger guard.

28. The sighting device of claim 27, wherein the sighting device is rigidly connected to the trigger guard and front strap.

29. The sighting device of claim 27, wherein the body comprises a left panel and a right panel that removably clamp the trigger guard.

* * * * *